US007955034B2

(12) United States Patent
Meidl

(10) Patent No.: US 7,955,034 B2
(45) Date of Patent: Jun. 7, 2011

(54) SLIDING ANCHOR

(75) Inventor: Michael Meidl, Seeboden (AT)

(73) Assignee: Atlas Copco Mai GmbH (AT)

( * ) Notice: Subject to any disclaimer, the term of this patent is extended or adjusted under 35 U.S.C. 154(b) by 66 days.

(21) Appl. No.: 12/438,562

(22) PCT Filed: Nov. 9, 2007

(86) PCT No.: PCT/EP2007/009733

§ 371 (c)(1),
(2), (4) Date: Feb. 24, 2009

(87) PCT Pub. No.: WO2008/055696

PCT Pub. Date: May 15, 2008

(65) Prior Publication Data

US 2009/0269159 A1 Oct. 29, 2009

(30) Foreign Application Priority Data

Nov. 10, 2006 (DE) ..... 10 2006 053 141

(51) Int. Cl.
*F16B 31/00* (2006.01)

(52) U.S. Cl. ..... 411/8; 411/5; 405/259.1

(58) Field of Classification Search ..... 411/8, 21, 411/82, 2–5, 9, 348, 351, 356; 405/259.1, 405/259.2, 259.5, 259.6
See application file for complete search history.

(56) References Cited

U.S. PATENT DOCUMENTS 2,822,986 A * 2/1958 Schreier ..... 238/377
2,829,502 A * 4/1958 Dempsey ..... 405/259.6
2,870,666 A * 1/1959 Dempsey ..... 411/67
3,319,209 A * 5/1967 Reyenga ..... 338/162
3,349,662 A 10/1967 Williams
3,967,455 A 7/1976 Conway
(Continued)

FOREIGN PATENT DOCUMENTS

DE 26 29 351 9/1977
(Continued)

OTHER PUBLICATIONS

Office Action (Mailed Date Dec. 4, 2008) for U.S. Appl. No. 11/231,128, filed Sep. 20, 2005; Confirmation No. 8182.

*Primary Examiner* — Gary Estremsky

(74) *Attorney, Agent, or Firm* — Schmeiser, Olsen & Watts, LLP

(57) ABSTRACT

The invention relates to a sliding anchor bolt (10) for introduction into a bore. The sliding anchor bolt (10) has a anchor bolt rod (12), disposed on which is a sliding control element (14) having a through-opening (18), through which the anchor bolt rod (12) extends. The sliding control element (14) comprises a sliding body cage (16) having at least one recess (20) for receiving a sliding body (22) that is in contact with the lateral surface of the anchor bolt rod (12). For precise and repeatable setting of a predefined breakaway force, each recess (22) for receiving a sliding body (22) is disposed in the sliding body cage (22) tangentially relative to the lateral surface of the anchor bolt rod (12). Furthermore, the lateral enveloping surface of each recess (20) projects by a predefined dimension into the free cross section of the through-opening (18), and each sliding body (22) fills the cross section of the recess (20) associated with it.

20 Claims, 5 Drawing Sheets

U.S. PATENT DOCUMENTS

Figure 1:
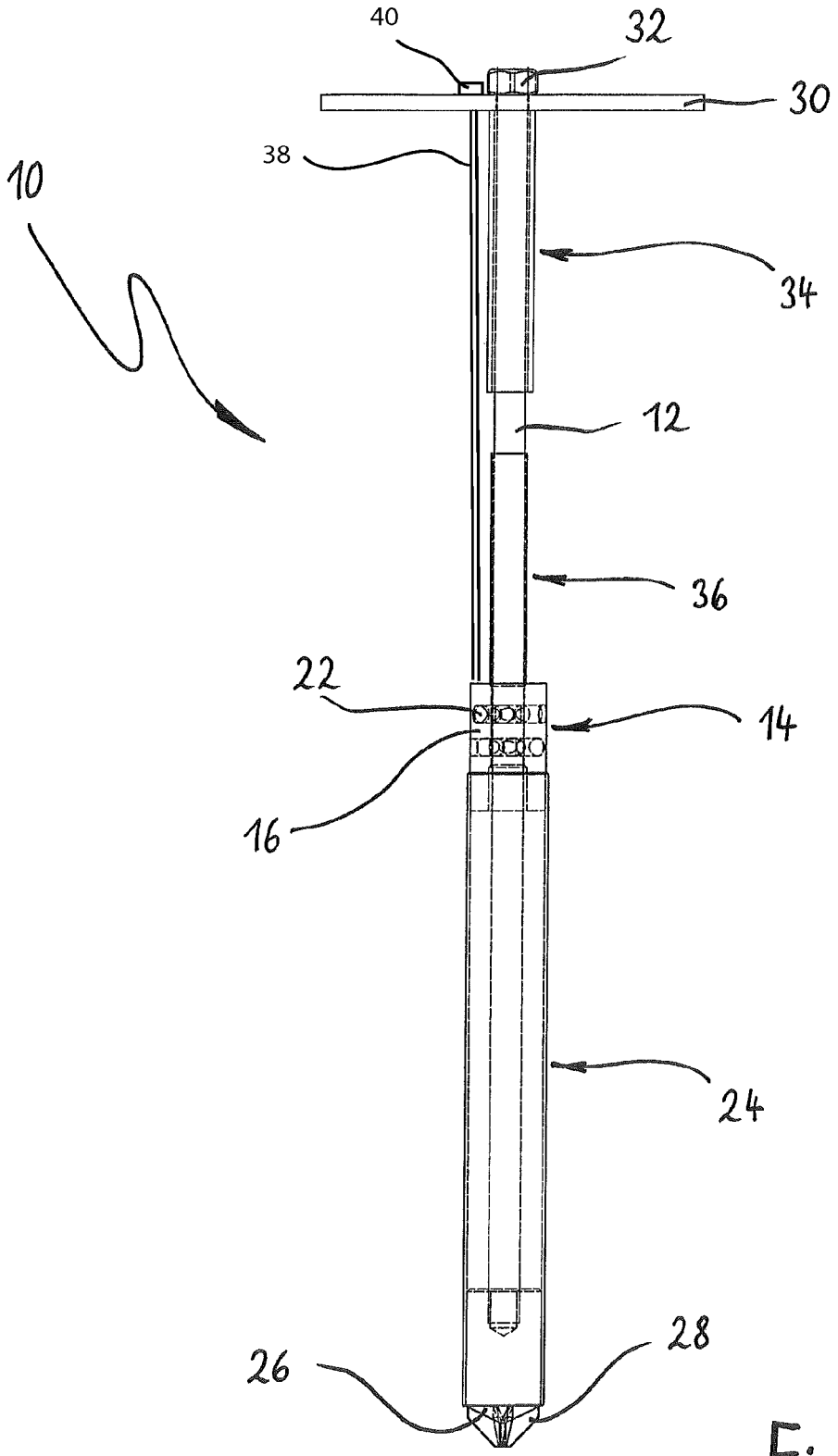

| | | | | |
|---|---|---|---|---|
| 4,195,952 | A * | 4/1980 | Swanson | 405/259.3 |
| 4,339,217 | A | 7/1982 | Lacey | |
| 4,378,180 | A | 3/1983 | Scott | |
| 4,403,894 | A | 9/1983 | Clark | |
| 4,431,348 | A | 2/1984 | Powondra | |
| 4,560,305 | A | 12/1985 | Powondra | |
| 4,630,971 | A | 12/1986 | Herbst et al. | |
| 4,681,495 | A * | 7/1987 | Crespin et al. | 411/298 |
| 4,776,729 | A | 10/1988 | Seegmiller | |
| 4,850,746 | A | 7/1989 | Finsterwalder et al. | |
| 4,932,642 | A * | 6/1990 | Salenbien et al. | 269/133 |
| 4,946,315 | A | 8/1990 | Chugh et al. | |
| 5,009,549 | A * | 4/1991 | Stankus | 405/259.5 |
| 5,161,916 | A | 11/1992 | White et al. | |
| 5,253,960 | A | 10/1993 | Scott | |
| 5,846,041 | A | 12/1998 | Bevan et al. | |
| 5,882,148 | A | 3/1999 | Mraz | |
| 5,885,031 | A | 3/1999 | White | |
| 6,474,910 | B2 | 11/2002 | Lay | |
| 6,626,610 | B1 | 9/2003 | Seegmiller | |
| 6,742,966 | B2 | 6/2004 | Cook | |
| 7,037,046 | B2 | 5/2006 | Fergusson | |
| 7,147,404 | B2 | 12/2006 | Spearing et al. | |
| 2004/0161316 | A1 | 8/2004 | Locotos et al. | |
| 2006/0067795 | A1 | 3/2006 | Spearing et al. | |
| 2006/0072972 | A1 | 4/2006 | Spearing et al. | |
| 2007/0031196 | A1 | 2/2007 | Bruneau | |
| 2009/0269159 | A1 | 10/2009 | Meidl | |

FOREIGN PATENT DOCUMENTS

| | | |
|---|---|---|
| DE | 2751020 | 5/1978 |
| DE | 3342746 A1 | 6/1984 |
| DE | 3311145 | 9/1984 |
| DE | 33 44 511 | 6/1985 |
| DE | 10354729 | 6/2005 |
| EP | 1533471 | 5/2005 |
| GB | 651556 | 4/1951 |
| JP | 02210199 | 8/1990 |
| SU | 926318 | 5/1982 |
| SU | 941607 | 7/1982 |
| WO | 9613651 | 5/1995 |
| WO | 00/08304 | 2/2000 |
| WO | 2005040556 | 5/2005 |

* cited by examiner

SLIDING ANCHOR

The invention relates to a sliding anchor bolt or yieldable rock bolt for introduction into a bore, wherein the sliding anchor bolt comprises a anchor bolt rod, disposed on which is a sliding control element with a through-opening, through which the anchor bolt rod extends, and wherein the sliding control element comprises a sliding body cage having at least one recess for receiving a sliding body that is in contact with the lateral surface of the anchor bolt rod. Such a sliding anchor bolt is known from WO 2006/034208 A1.

Sliding anchor bolts belong to the group of so-called rock bolts. Rock bolts are used in mining, tunnel construction and special underground working to stabilize the wall of a gallery or tunnel. For this purpose, from the gallery or tunnel there is driven in the rock a bore that is usually between two and twelve meters long. Into this bore a rock bolt of a corresponding length is then introduced, the end region of which is permanently fastened in the bore by means of mortar, by special-purpose synthetic-resin adhesives or by mechanical bracing. An anchor plate is normally mounted onto the end of the anchor bolt projecting from the bore and is clamped by means of a nut against the wall of the gallery or tunnel. In this way, loads acting in the region of the gallery- or tunnel wall may be introduced into deeper rock strata. In other words, with the aid of such rock bolts rock strata more remote from the wall are used for load transmission in order to minimize the risk of collapse of the gallery or tunnel.

Conventional rock bolts are able to transmit a maximum load corresponding to their mechanical design and break in the event of this load being exceeded (so-called load at break). In order as far as possible to prevent such a total failure of a placed rock bolt being triggered for example by rock displacements, so-called sliding anchor bolts or yieldable rock bolts have been developed, which, in the event of a predetermined load being exceeded, yield in a defined manner, i.e. are able to increase their length within specific limits in order to reduce a stress acting in the rock to an amount that the anchor bolt is still capable of transmitting. With such sliding anchor bolts it is desirable for the force, at which the sliding anchor bolt yields in a defined manner, to be adjustable as precisely as possible and also to fluctuate as little as possible during the yielding in order, on the one hand, to enable an exact mechanical design of the rock bolt and, on the other hand, to be able to realize a behaviour during operation that is predictable as well as possible. Also, the so-called breakaway force, i.e. the force, from the exceeding of which onwards the sliding anchor bolt yields in a defined manner, is to be repeatable so that the loading of the sliding anchor bolt does not vary in an uncontrolled manner during various, time-discrete phases of such a defined yielding.

The invention has set itself the object of providing an, in this respect, improved sliding anchor bolt. Proceeding from the initially described, known sliding anchor bolt this object is achieved according to the invention in that each recess for receiving a sliding body is disposed in the sliding body cage tangentially to the lateral surface of the anchor bolt rod, that moreover the lateral enveloping surface of each recess projects by a predefined dimension into the free cross section of the through-opening, and that finally each sliding body fills the cross section of the recess associated with it. In the present case, by the expression "tangentially to the lateral surface of the anchor bolt rod" is meant, not an exact tangentially in the mathematical sense, whereby the lateral enveloping surface of the recess would only touch the lateral surface of the anchor bolt rod, but a substantially tangential arrangement of the recesses intended to receive sliding bodies relative to the lateral surface of the anchor bolt rod, whereby the central longitudinal axis of each recess is disposed skew relative to the central longitudinal axis of the anchor bolt rod, wherein in a projection of the central longitudinal axis of the anchor bolt rod and the central longitudinal axis of any recess for receiving a sliding body these two axes may be, but need not be, orthogonal relative to one another. The central longitudinal axis of a recess for receiving a sliding body may accordingly lie in a plane that cuts the central longitudinal axis of the anchor bolt rod at right angles (the axes in question in the described projection are then orthogonal relative to one another) but may however also lie in a plane that is inclined relative to the central longitudinal axis of the anchor bolt rod.

The design according to the invention of a sliding anchor bolt has a number of advantages. As the lateral enveloping surface of each recess provided in the sliding body cage for receiving a sliding body projects by a predefined dimension into the free cross section of the through-opening of the sliding control element, it is possible with the aid of this dimension to preset very precisely the clamping force, with which the sliding body or sliding bodies secure the anchor bolt rod extending through the through-opening. Furthermore, this clamping force, once set, after a single start-up operation is also repeatably achievable since each sliding body except for conventional tolerances fills the cross section of the recess associated with it, so that the predefined dimension, by which each sliding body projects into the free cross section of the through-opening, does not vary during operation of the sliding anchor bolt, in particular not even if during operation a plurality of time-discrete sliding phases of the anchor bolt rod occur. Finally, the load transmission between the anchor bolt rod when sliding and the sliding control element is advantageously solved since, because the sliding bodies fill the cross section of the recesses, material deformation occurs not at the sliding bodies and at the sliding body cage but only at the anchor bolt rod. The precondition for this is of course that—as already in the case of the cited prior art—the material hardness of the sliding bodies is greater than that of the anchor bolt rod.

Further measures of influence, by which the clamping- and/or breakaway force may be influenced, are the shape of the sliding body or bodies and of the sliding body cage, the number of sliding bodies, the nature of their surface in contact with the anchor bolt rod, the material pairings between sliding body and anchor bolt rod as well as between sliding body and sliding body cage, as well as the shape and nature of the surface of the anchor bolt rod.

In principle, the sliding anchor bolt according to the invention is already functional with one recess and one sliding body disposed therein. However, in the sliding body cage preferably a plurality of recesses are disposed and are advantageously arranged distributed around the circumference of the anchor bolt rod, in particular uniformly distributed around the circumference. By means of a plurality of recesses and a corresponding number of sliding bodies it is possible to set the desired breakaway force even more exactly, and moreover with a plurality of recesses and sliding bodies disposed therein it is easily possible to realize higher clamping- and/or breakaway forces. A uniform distribution of recesses and sliding bodies around the circumference of the anchor bolt rod achieves a more uniform distribution of the loads acting upon the anchor bolt rod.

Each of the plurality of recesses may be disposed at a different level in the sliding body cage, i.e. each in its own cross-sectional plane of the sliding body cage. However, in order to achieve a more compact style of construction of the sliding control element, preferably a plurality of recesses are disposed in one cross-sectional plane of the sliding body cage. The number of recesses possible in one cross-sectional plane depends on the dimension of the recesses and the dimension of the sliding body cage. In a development of a sliding anchor bolt according to the invention three recesses are disposed in a cross-sectional plane but, in the case of a sliding anchor bolt of larger dimensions with a correspondingly larger sliding control element, there may be even more than three such recesses. Moreover, likewise with a view to achieving a compact style of construction and uniform load distribution, preferably a plurality of recesses are disposed in groups in various cross-sectional planes of the sliding body cage. Such a development is selected preferably when the spatial conditions do not permit an arrangement of the desired number of recesses in a cross-sectional plane. For example, in another form of construction of the sliding anchor bolt according to the invention, in each case three recesses are disposed in two different cross-sectional planes of the sliding body cage. The recesses of the different cross-sectional planes are in this case advantageously offset at an angle relative to one another in such a way that the sliding bodies disposed in the recesses of the one cross-sectional plane contact different regions of the lateral surface of the anchor bolt rod than the sliding bodies in the other cross-sectional plane or planes.

Within the scope of the present invention, it is possible to select virtually any desired shape for the sliding bodies that are used. For example, the sliding bodies may be spherical or they may have a tapering external shape, for example be taper-roller-shaped. According to a preferred form of construction, the sliding bodies have a circular-cylindrical shape, i.e. are roller-shaped. Furthermore, the lateral surface of each sliding body may be crowned, i.e. bulge outwards, for example in the manner of a wine barrel. Prism-shaped sliding bodies are equally possible. It is self-evident that the shape of the recesses has to be adapted to the sliding bodies that are used, at least to the extent that each sliding body is accommodated substantially free of play in its recess. As a rule, the shape of the recess will correspond to the shape of the sliding body used, i.e. a circular-cylindrical sliding body will be disposed in a circular-cylindrical recess, a conical sliding body in a conical recess etc., although this correspondence is not mandatory.

In the case of the sliding anchor bolt according to the invention, there are basically two possible ways of arranging the sliding control element. One way is to dispose the sliding control element on a portion of the anchor bolt rod that is intended for introduction into the bore. The maximum sliding distance of the sliding anchor bolt is then the distance, by which the anchor bolt rod on the far side of the sliding control element extends into the bore. In order, given such a form of construction, to prevent the anchor bolt rod from detaching from the sliding control element once the maximum sliding distance has been traveled, in preferred forms of construction in the region of the bore-side end of the anchor bolt rod there is a stop element, the diameter of which is larger than the diameter of the through-opening in the sliding control element. Thus, the anchor bolt rod is unable to slide through the sliding control element. For example, the stop element is a nut, which is screwed or fastened in some other way onto the bore-side end portion of the anchor bolt rod. When the stop element after travelling the maximum possible sliding distance strikes against the sliding control element, a further defined yielding of the sliding anchor bolt is no longer possible. The sliding anchor bolt may then be loaded up to its load at break, which is a factor of the mechanical design, and, after the load at break is exceeded, will fail, for example the anchor bolt rod will then break.

In order reliably to guarantee that the part of the anchor bolt rod that projects beyond the sliding control element into the bore may, where necessary, shift by sliding through the sliding control element, in preferred forms of construction of the sliding anchor bolt according to the invention a first protective tube that concentrically surrounds the anchor bolt rod extends from the sliding control element to the bore-side end of the anchor bolt rod. On the one hand, this prevents mortar or optionally used adhesive resins from coming into contact with and possibly blocking the anchor bolt rod, i.e. in this way it is guaranteed that the portion of the anchor bolt rod that is surrounded by the first protective tube may run freely through the sliding control element. The mortar or adhesive, which is usually introduced prior to the anchor bolt into the bore, is displaced upon introduction of the anchor bolt into the bore and some flows past the outside of the first protective tube, so that with this form of construction, promoted by the first protective tube, at the outside of the sliding anchor bolt behind the sliding control element, i.e. at the side thereof facing the bore mouth, a plug of the synthetic-resin material or mortar used to fix the anchor bolt forms in the bore. This plug, after setting of the material, performs the function of an abutment, against which the sliding control element and hence the entire anchor bolt is supported. The possibility of the anchor bolt being pulled out of the bore is therefore reliably prevented. Such a first protective tube concentrically surrounding the anchor bolt rod is however also advantageous if the sliding anchor bolt is jammed in the bore by means of bracing, for example using an expansion sleeve, because the protective tube also keeps away from the sliding section, i.e. the portion of the anchor bolt rod intended for sliding, loose rock material that might otherwise have a disturbing effect, and also protects the sliding section from corrosion. Preferably, the outside diameter of the first protective tube corresponds substantially to the outside diameter of the sliding control element, with the result that from the sliding control element to the bore-side end of the sliding anchor bolt there is an at least approximately uniform outside diameter that facilitates introduction of the sliding anchor bolt into the bore.

In order to protect a bore-mouth-side portion of the anchor bolt rod from shearing forces that may be exerted on the anchor bolt rod by the tunnel- or gallery wall, preferred embodiments of the sliding anchor bolt according to the invention are provided with a second protective tube, which concentrically surrounds the anchor bolt rod and extends from the already mentioned anchor plate, which closes the bore mouth, a little distance into the bore. In a constructionally advantageous manner, such a second protective tube may be connected in a fixed manner to the anchor plate, for example by welding or screw fastening or by an integral construction with the anchor plate.

To protect the anchor bolt rod from the synthetic-resin material or mortar used to fix the anchor bolt and also as protection against corrosion, preferred forms of construction additionally comprise a third protective tube, which concentrically surrounds the anchor bolt rod and which for example may be made of plastics material and extend from the sliding control element a little distance in the direction of the end of the anchor bolt rod that projects from the bore, i.e. in the direction of the bore mouth. Thus, in this region too it is ensured that the anchor bolt rod will not become jammed and, after the breakaway force has been exceeded, will be able to shift in a controlled manner, i.e. substantially independently of interfering influences. The third protective tube may alternatively be formed by a heat-shrinkable sleeve or merely a coating, which is applied onto the portion of the anchor bolt rod that is to be protected.

In order, after a sliding anchor bolt according to the invention has been placed with its sliding control element situated in the bore, to be able to establish from outside whether a rock movement has occurred, i.e. whether after placing of the anchor bolt a sliding movement of the anchor bolt rod in the sliding control element has occurred as a result of the breakaway force being exceeded, preferred forms of construction of the sliding anchor bolt according to the invention are provided with a monitoring device. In a simple form, this may comprise for example a monitoring wire that is stretched from the sliding control element to the anchor plate and is preferably accessible from the outside of the anchor plate, i.e. from the side of the anchor plate remote from the bore. If, after the placing of a sliding anchor bolt thus equipped, rock movements occur and lead to the exceeding of the breakaway force and hence cause a sliding of the anchor bolt rod relative to the sliding control element, this monitoring wire breaks and may then easily be pulled out from the outside. If, on the other hand, upon an inspection of the placed sliding anchor bolt the monitoring wire is still stretched and hence fastened to the sliding control element, the monitoring wire is impossible to pull out of the bore and therefore indicates that in the meantime no rock movements leading to the exceeding of the breakaway force of the anchor bolt have occurred. The monitoring wire may be made of metal or alternatively of plastics material or may be a thread or the like.

Besides the previously discussed possibility of disposing the sliding control element on a portion of the anchor bolt rod that is situated in the bore, there is also the alternative possibility of disposing the sliding control element outside of the bore, i.e. on a portion of the anchor bolt rod that extends beyond the anchor plate out of the bore. With this possibility it is however necessary for the entire length of the anchor bolt rod that is provided for sliding to project from the bore mouth and hence correspondingly limit the free cross section of the gallery or tunnel, this as a rule being a serious disadvantage. The advantage of disposing a sliding control element outside of the bore is that it is easy to monitor variations that have occurred meanwhile because, on the basis of the original projecting length of the anchor bolt rod, it may always be established precisely to what extent a sliding movement has meanwhile occurred.

Independently of whether the sliding control element is situated on a portion of the anchor bolt rod inside the bore or outside of the bore, in preferred embodiments of sliding anchor bolts according to the invention a mixing element is fastened to the bore-side end of the anchor bolt rod. If two-component adhesive resins are used to fix the anchor bolt in the bore, the two components are usually introduced into the bore in the form of adhesive cartridges, in which the two components are accommodated separately from one another, for example in two chambers that are concentric with one another. During placing of the anchor bolt, the mixing element then first destroys the chambers formed for example from a plastic film and a simultaneous or subsequent rotation of the anchor bolt rod then leads to the intimate mixing of the two components, which consequently cure rapidly into the finished adhesive resin. In addition to its mixing function, the mixing element may also serve as the previously already mentioned stop element.

Figure 2:
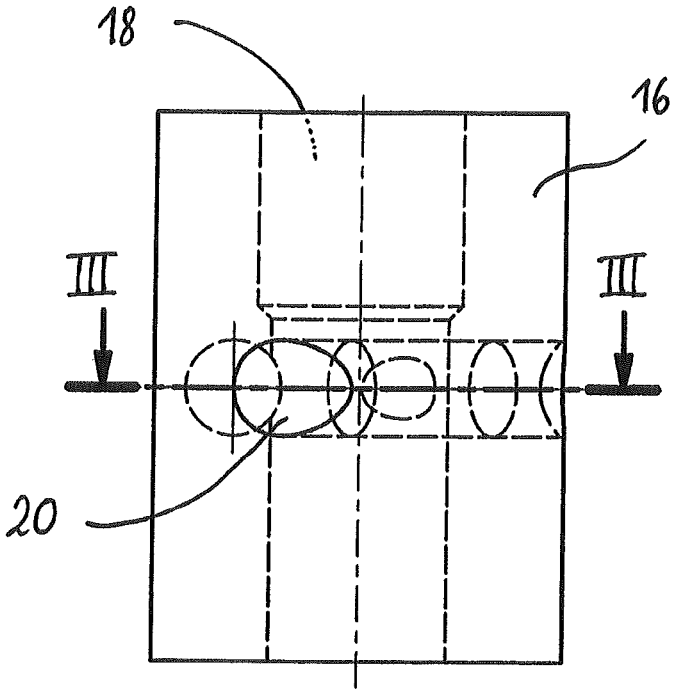
Figure 3:
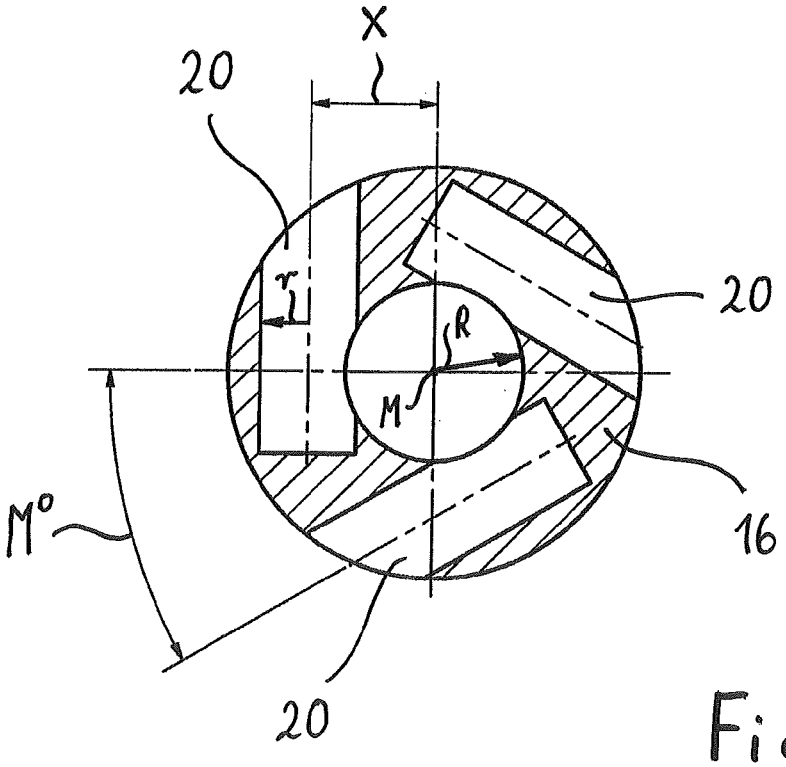
Figure 4:
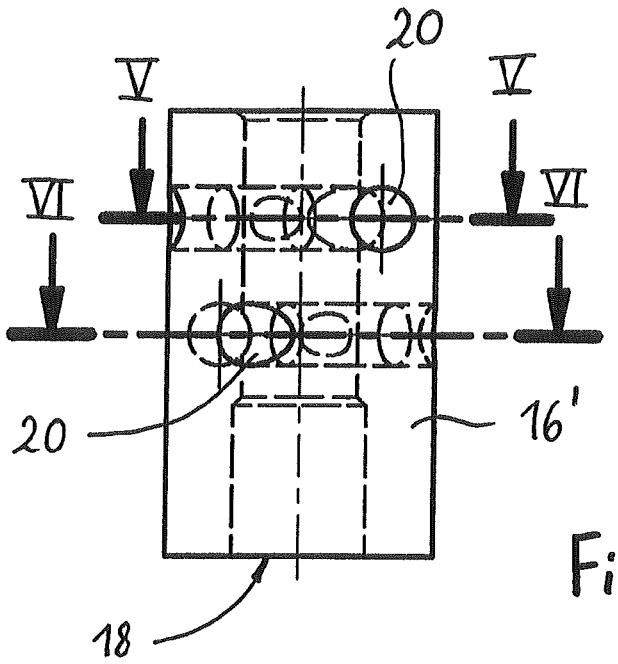
Figure 5:
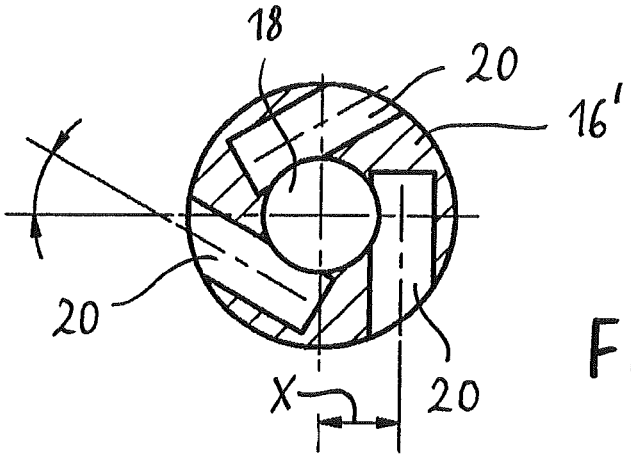
Figure 6:
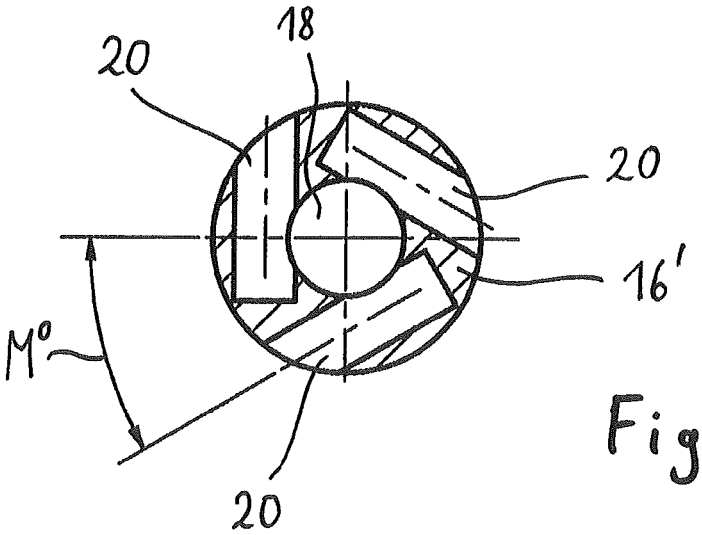
Figure 7:
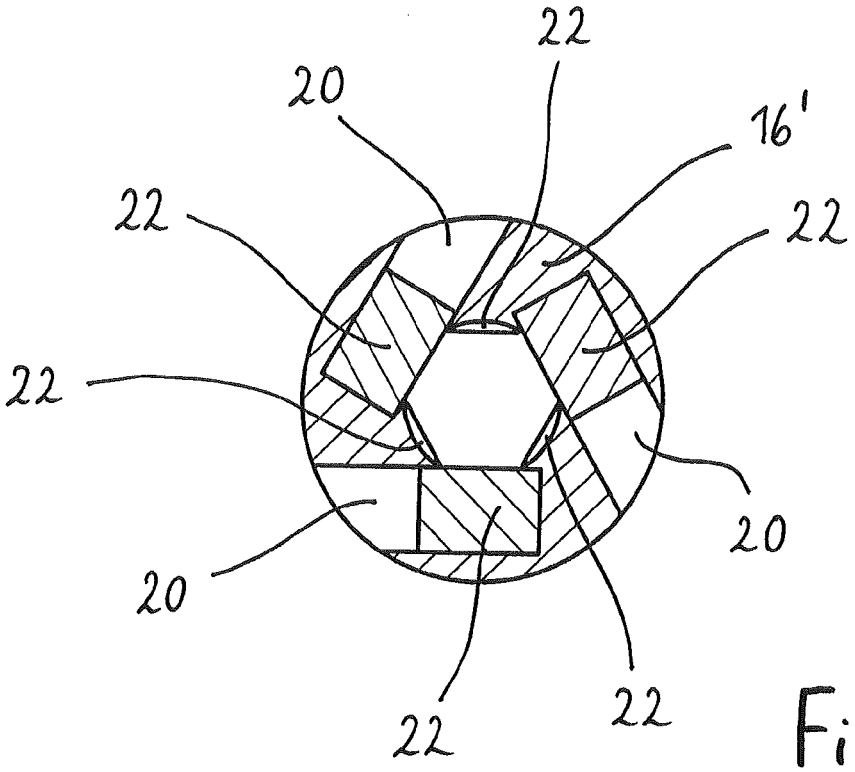
Figure 8:
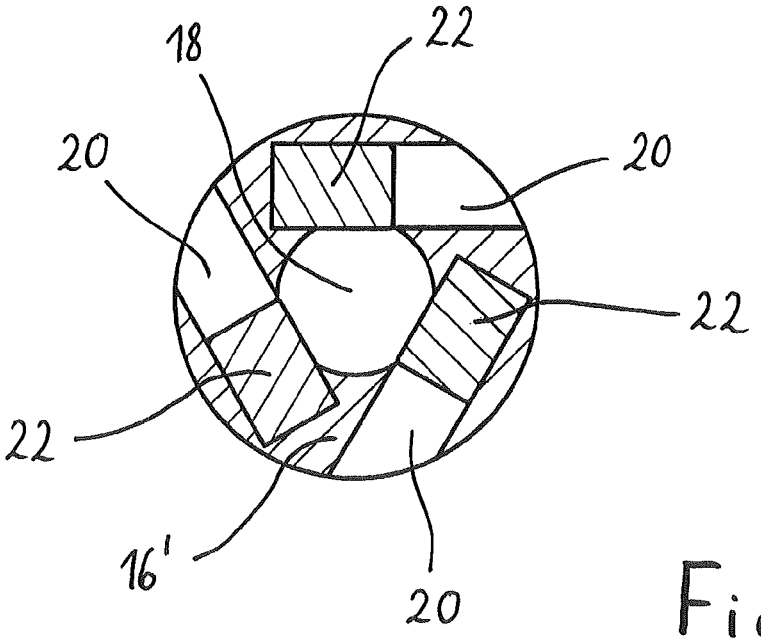

A currently preferred embodiment of a sliding anchor bolt according to the invention is described in detail below with reference to the accompanying diagrammatic figures. These show:

FIG. 1 a plan view of a preferred embodiment of a sliding anchor bolt according to the invention, FIG. 2 a first form of construction of a sliding body cage such as is used in a sliding control element of a sliding anchor bolt according to the invention, FIG. 3 the section III-III of FIG. 2, FIG. 4 a second embodiment of a sliding body cage such as is used in the sliding control element of the sliding anchor bolt shown in FIG. 1, FIG. 5 the section V-V of FIG. 4, FIG. 6 the section VI-VI of FIG. 4, FIG. 7 a view corresponding to FIG. 5 but with sliding bodies inserted into the sliding body cage, and FIG. 8 a view corresponding to FIG. 6, likewise with sliding bodies inserted into the sliding body cage.

Figure 9:
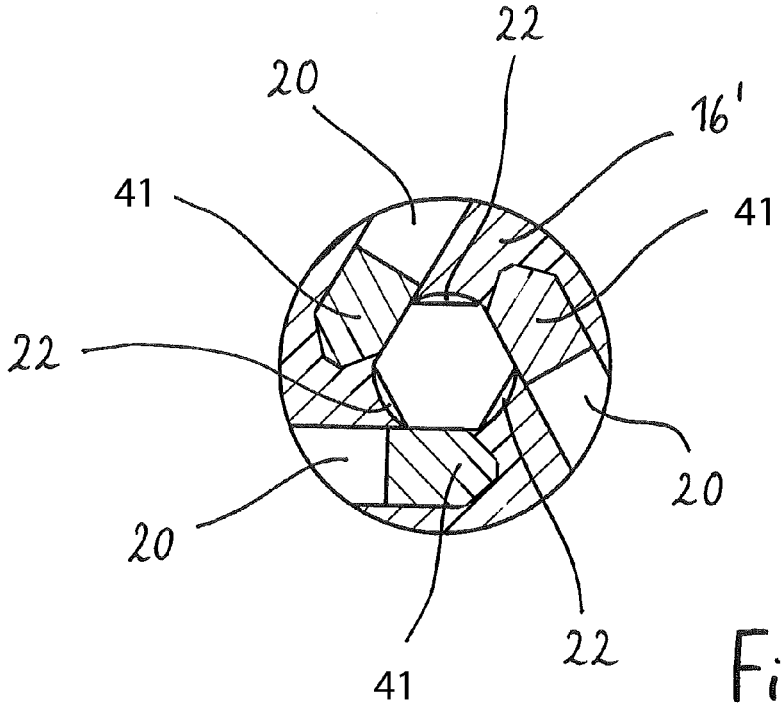
Figure 10:
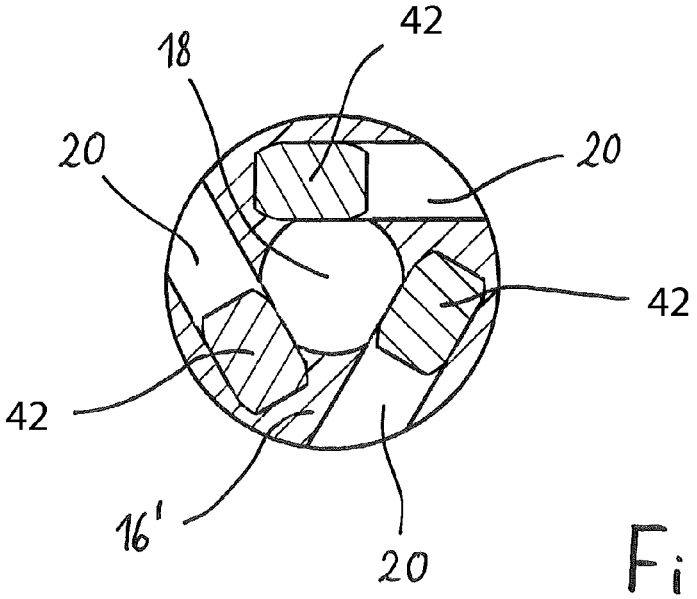

FIG. 9 a top view showing a sliding body cage with a conical shaped sliding body that is in particular taper-roller-shaped that is inserted into the sliding body cage. FIG. 10 a top view showing a sliding body cage with a crowned sliding body that is inserted into the sliding body cage.

FIG. 1 shows a sliding anchor bolt that is denoted generally by 10 and is provided for introduction into a non-illustrated rock bore in order to stabilize for example the wall of a gallery or tunnel. The central element of this sliding anchor bolt 10 is an anchor bolt rod 12, which is the load-bearing component of the sliding anchor bolt 10 and the length of which determines the length of the sliding anchor bolt 10. In the illustrated embodiment the anchor bolt rod 12 is a solid, continuous steel rod with a circular cross section and a diameter of 12 mm as well as a smooth lateral surface, the length of which here is two meters. Depending on the desired load transmission capacity, the diameter of the anchor bolt rod 12 may however be smaller or larger than 12 mm and its length too may, depending on the operating conditions, be shorter or longer than previously indicated. The lateral surface of the anchor bolt rod 12 moreover need not be smooth but may be for example roughened, grooved etc. Although anchor bolt rods with a circular cross section are preferred, the invention is not limited thereto and the cross section of the anchor bolt rod may alternatively be for example square, polygonal etc.

On a portion of the anchor bolt rod 12 that is provided for introduction into the non-illustrated rock bore a sliding control element 14 is disposed, the basic structure of which may be seen more clearly in FIGS. 2 and 3. The sliding control element 14 is used to allow a limited longitudinal displacement of the anchor bolt rod 12 relative to the sliding control element 14 so that the sliding anchor bolt 10 is better able to cope with rock displacements arising after its placement and does not fail prematurely.

The sliding control element 14 comprises a circular-cylindrical sliding body cage 16 having a central, axially extending through-opening 18, which in the illustrated example is of a slightly stepped design and through which in the assembled state of the sliding anchor bolt 10 the anchor bolt rod 12 extends.

In order, after the sliding anchor bolt 10 according to the invention has been placed with its sliding control element 14 situated in the bore, to be able to establish from outside whether a rock movement has occurred, i.e. whether after placing of the anchor bolt 10 a sliding movement of the anchor bolt rod 12 in the sliding control element 14 has occurred as a result of the breakaway force being exceeded, preferred forms of construction of the sliding anchor bolt 10 according to the invention are provided with a monitoring device 40. In a simple form, this may comprise for example a monitoring wire 38 that is stretched from the sliding control element 14 to an anchor plate 30 and is preferably accessible from the outside of the anchor plate 30, i.e. from the side of the anchor plate 30 remote from the bore. If, after the placing of a sliding anchor bolt 10 thus equipped, rock movements occur and lead to the exceeding of the breakaway force and hence cause a sliding of the anchor bolt rod 12 relative to the sliding control element 14, this monitoring wire 38 breaks and may then easily be pulled out from the outside. If, on the other hand, upon an inspection of the placed sliding anchor bolt 10 the monitoring wire 38 is still stretched and hence fastened to the sliding control element 14, the monitoring wire 38 is impossible to pull out of the bore and therefore indicates that in the meantime no rock movements leading to the exceeding of the breakaway force of the anchor bolt 10 have occurred. The monitoring wire 38 may be made of metal or alternatively of plastics material or may be a thread or the like.

As is evident from the section shown in FIG. 3, three recesses 20 in the form of circular-cylindrical bores are formed uniformly distributed around the circumference of the sliding body cage 16 and are disposed in such a way that their lateral enveloping surface projects slightly into the free cross section of the through-opening 18. In other words, a dimension X that defines the distance between the centre M of the through-opening 18 and the central longitudinal axis of each recess 20 is slightly smaller than the sum of the radius R of the through-opening 18 and the radius r of the recess 20.

The recesses 20 are disposed substantially tangentially relative to the lateral surface of the anchor bolt rod 12, i.e. their central longitudinal axes are skew relative to the central longitudinal axis of the through-opening 18 and, in relation to a projection that contains the central longitudinal axis of the through-opening 18 and the central longitudinal axis of in each case one recess 20, are orthogonal relative to the central longitudinal axis of the through-opening 18. The three recesses 20 are therefore disposed in one and the same cross-sectional plane of the sliding body cage 16. An angle M° in the illustrated embodiment is 30°.

In FIGS. 4 to 6 a second embodiment of a sliding body cage 16' is represented, the basic structure of which corresponds to the sliding body cage 16. In contrast to the sliding body cage 16, the sliding body cage 16' however has two planes, which are disposed one above the other and each have three recesses 20, wherein the recesses 20 of the one cross-sectional plane are offset in peripheral direction relative to the recesses 20 of the other cross-sectional plane in such a way that all six recesses 20 together are uniformly distributed around the circumference of the sliding body cage 16'.

Each recess 20 is provided for receiving an, in the present case, circular-cylindrical sliding body 22, the outside diameter of which except for conventional tolerances corresponds to the diameter of the recess 20 and which therefore completely fills the cross section of the recess 20. FIGS. 7 and 8 show views, which correspond to FIGS. 5 and 6 and in which a sliding body 22 of the previously described design is disposed in each recess 20. As may be seen clearly in particular from FIG. 7, because of the described arrangement of the recesses 20 each sliding body 22 projects with its lateral surface slightly into the cross section of the through-opening 18. Thus, the anchor bolt rod 12, the outside diameter of which almost corresponds to the diameter of the through-opening 18, is held clamped by the sliding bodies 22.

Within the scope of the present invention, it is possible to select virtually any desired shape for the sliding bodies that are used. For example, the sliding bodies may be spherical or they may have a tapering external shape, for example be taper-roller-shaped. According to a preferred form of construction, sliding bodies 41 have a circular-cylindrical shape, i.e. are roller-shaped, as shown in FIG. 9. Furthermore, the lateral surface of a sliding body 42 may be crowned, i.e. bulge outwards, for example in the manner of a wine barrel, as shown in FIG. 10. Prism-shaped sliding bodies are equally possible. It is self-evident that the shape of the recesses has to be adapted to the sliding bodies that are used, at least to the extent that each sliding body is accommodated substantially free of play in its recess. As a rule, the shape of the recess will correspond to the shape of the sliding body used, i.e. a circular-cylindrical sliding body will be disposed in a circular-cylindrical recess, a conical sliding body in a conical recess etc., although this correspondence is not mandatory.

Returning to FIG. 1, there now follows a description of the further structure of the sliding anchor bolt 10.

From the sliding control element 14, the main components of which are, as described above, the sliding body cage 16 or 16' and the sliding bodies 22 accommodated therein, a first protective tube 24 made here of plastics material extends almost to the bore-side end of the sliding anchor bolt 10. This protective tube 24, which in the illustrated embodiment has substantially the same outside diameter as the sliding body cage 16', is used to keep away from the surface of the anchor bolt rod 12 the substance (mortar, adhesive) that is used to anchor the sliding anchor bolt 10 permanently in the non-illustrated bore. The first protective tube 24 accordingly creates on a bore-side end portion of the sliding anchor bolt 10 an annular-cylindrical hollow space around the anchor bolt rod 12 that prevents the latter from becoming blocked by the mortar or adhesive and hence being prevented from displacement relative to the sliding control element 14.

The tip of the sliding anchor bolt 10 is formed by a mixing element 26 having a plurality of mixing blades 28, which is fastened to the bore-side end of the anchor bolt rod 12 and used to effect an intimate mixing of conventional two-component adhesives, which are used to fix rock bolts and are introduced prior to the placing of a anchor bolt into the bore. For this purpose, the anchor bolt rod 12 after being inserted into the bore is rotated, with the result that the mixing element 26 is also being rotated.

The outside diameter of the mixing element 26 is larger than the diameter of the through-opening 18 in the sliding body cage 16 or 16'. The mixing element 26 therefore acts simultaneously as a stop element on the end portion of the anchor bolt rod 12 that prevents the anchor bolt rod 12 from being able to be pulled out of the sliding control element 14. Alternatively, such a stop element may take the form of a threaded nut or be formed simply by a thickening of the anchor bolt rod 12 that is produced for example by an upsetting deformation of the anchor bolt rod.

To enable the sliding anchor bolt 10 to exert a stabilizing influence on a gallery- or tunnel wall, a load-transmitting anchor plate 30 is provided, which is mounted onto the bore-entry-side end of the anchor bolt rod 12. This anchor plate 30, which is conventionally made likewise of steel and as a rule is square, is fastened by a lock nut 32 on the anchor bolt rod 12.

In the illustrated embodiment a second protective tube 34, which is connected in a fixed manner to the anchor plate 30 and here is made likewise of steel, extends a little distance into the non-illustrated bore in order to protect a leading portion of the anchor bolt rod 12 from loose rock. For this purpose, the inside diameter of the second protective tube 34 is selected larger than the outside diameter of the anchor bolt rod 12. The outside diameter of the second protective tube 34 is markedly smaller than the outside diameter of the first protective tube 24 in order to facilitate introduction into the bore.

Finally, in the illustrated embodiment a middle portion of the anchor bolt rod 12 is concentrically surrounded by a third protective tube 36 that extends from the sliding control element 14 in the direction of the anchor plate 30. This third protective tube 36 is used to keep unwanted influences away from the surface of the anchor bolt rod 12, in particular a gluing of the anchor bolt rod in this region.

There now follows a detailed description of the function of the sliding anchor bolt 10. After the formation of a suitable bore, the sliding anchor bolt 10 is introduced into the bore and anchored there by means of mortar or adhesives known to experts in this field. Alternatively, the use of expandable elements for anchoring is possible and known, for example the use of expansion sleeves. The illustrated sliding anchor bolt 10 is held fast in the bore in particular by means of a plug that forms as a result of a displacement of material of the employed adhesive or mortar behind the sliding control element 14, i.e. at the bore mouth side, and after curing of the material prevents the anchor bolt 10 from being pulled out of the bore. After the anchor plate 30 has been mounted and drawn up by means of the lock nut 32, the sliding anchor bolt 10 may then perform its load-bearing, stabilizing function.

Via the sliding bodies 22 a clamping action is exerted on the anchor bolt rod 12 and this defines a so-called breakaway force, which the sliding anchor bolt 10 may transmit in axial direction without this leading to a relative movement between the anchor bolt rod 12 and the sliding control element 14. However, if this breakaway force is exceeded, the anchor bolt rod 12 may move by sliding along the sliding bodies 22 until the mixing element 26 serving as a stop element strikes against the sliding body cage 16 or 16'. Such a relative displacement may naturally occur in a plurality of segments and will always occur only until the axial force acting upon the sliding anchor bolt 10 has dropped once more below the breakaway force. By virtue of this relative displacement the effective length of the sliding anchor bolt 10 increases, because the sliding control element 14 and the first protective tube 24 maintain their original position that is adopted during placing of the anchor bolt.

The invention claimed is:

1. Sliding anchor bolt for introduction into a bore, having a anchor bolt rod, disposed on which is a sliding control element having a through-opening, through which the anchor bolt rod extends, wherein the sliding control element comprises a sliding body cage having at least one recess for receiving a sliding body that is in contact with a lateral surface of the anchor bolt rod, wherein each recess for receiving the sliding body is disposed in the sliding body cage tangentially relative to the lateral surface of the anchor bolt rod, a lateral enveloping surface of each recess projects by a predefined dimension into a free cross section of the through-opening, and each sliding body fills the transverse cross section of the recess associated with it.

2. Sliding anchor bolt according to claim 1, wherein in the sliding body cage a plurality of recesses are disposed in particular in a uniformly distributed manner around the circumference of the anchor bolt rod.

3. Sliding anchor bolt according to claim 2, wherein a plurality of recesses are disposed in a cross-sectional plane of the sliding body cage.

4. Sliding anchor bolt according to claim 2, wherein the plurality of recesses are disposed in groups in various cross-sectional planes of the sliding body cage.

5. Sliding anchor bolt according to claim 1, wherein each sliding body is conical, in particular taper-roller-shaped.

6. Sliding anchor bolt according to claim 1, wherein the lateral surface of each sliding body is crowned.

7. Sliding anchor bolt according to claim 1, wherein each sliding body is cylindrical, in particular roller-shaped.

8. Sliding anchor bolt according to claim 1, wherein in the region of the bore-side end of the anchor bolt rod a stop element is fastened, the diameter of which is larger than the diameter of the through-opening.

9. Sliding anchor bolt according to claim 7, wherein the stop element is a nut.

10. Sliding anchor bolt according to claim 1, wherein the sliding control element is disposed on a portion of the anchor bolt rod that is intended for introduction into the bore.

11. Sliding anchor bolt according to claim 9, wherein a first protective tube that concentrically surrounds the anchor bolt rod extends from the sliding control element substantially to the bore-side end of the anchor bolt rod.

12. Sliding anchor bolt according to claim 10, wherein the outside diameter of the first protective tube corresponds to the outside diameter of the sliding control element.

13. Sliding anchor bolt according to claim 1, wherein a anchor plate is fastened in the region of the end of the anchor bolt rod that projects from the bore.

14. Sliding anchor bolt according to claim 12, wherein a second protective tube that concentrically surrounds the anchor bolt rod extends from the anchor plate a little distance in the direction of the bore-side end of the anchor bolt rod.

15. Sliding anchor bolt according to claim 12, wherein the second protective tube is connected in a fixed manner to the anchor plate.

16. Sliding anchor bolt according to claim 9, wherein a third protective tube that concentrically surrounds the anchor bolt rod extends from the sliding control element a little distance in the direction of the end of the anchor bolt rod that projects from the bore.

17. Sliding anchor bolt according, to claim 9, wherein a monitoring wire is stretched from the sliding control element to the anchor plate and is accessible from the side of the anchor plate remote from the bore.

18. Sliding anchor bolt according to claim 1, wherein a monitoring device is provided, which indicates whether a sliding of the anchor bolt rod relative to the sliding control element has occurred.

19. Sliding anchor bolt according to claim 17, wherein the monitoring device indicates the distance, by which the anchor bolt rod has shifted relative to the sliding control element.

20. Sliding anchor bolt according to claim 1, wherein a mixing element is fastened to the bore-side end of the anchor bolt rod.

* * * * *

UNITED STATES PATENT AND TRADEMARK OFFICE

CERTIFICATE OF CORRECTION

PATENT NO. : 7,955,034 B2
APPLICATION NO. : 12/438562
DATED : June 7, 2011
INVENTOR(S) : Michael Meidl It is certified that error appears in the above-identified patent and that said Letters Patent is hereby corrected as shown below:

in column 10, line 17, claim 9, “according to claim 7” should read --according to claim 8--;
in column 10, line 22, claim 11, “according to claim 9” should read --according to claim 10--;
in column 10, line 26, claim 12, “according to claim 10” should read --according to claim 11--;
in column 10, line 32, claim 14, “according to claim 12” should read --according to claim 13--;
in column 10, line 36, claim 15, “according to claim 12” should read --according to claim 13--;
in column 10, line 39, claim 16, “according to claim 9” should read --according to claim 10--;
in column 10, line 44, claim 17, “according to claim 9” should read --according to claim 10--;
in column 10, line 52, claim 19, “according to claim 17” should read --according to claim 18--.

Signed and Sealed this
Twenty-third Day of August, 2011

David J. Kappos

David J. Kappos
*Director of the United States Patent and Trademark Office*